United States Patent [19]

Wallerstein

[11] 4,173,854

[45] Nov. 13, 1979

[54] BOWED SKYLIGHT

[76] Inventor: Martin A. Wallerstein, 29 Oakwood Ave., Norwalk, Conn. 06851

[21] Appl. No.: 885,887

[22] Filed: Mar. 13, 1978

[51] Int. Cl.[2] ..... E04B 7/18; E04D 13/03

[52] U.S. Cl. ..... 52/200

[58] Field of Search ..... 52/200, 199

[56] References Cited

U.S. PATENT DOCUMENTS

| | | | |
|---|---|---|---|
| 3,127,699 | 4/1964 | Wasserman | 52/200 |
| 3,325,951 | 6/1967 | Johnson | 52/200 |
| 3,440,779 | 4/1969 | Helma | 52/200 |

FOREIGN PATENT DOCUMENTS

| | | | |
|---|---|---|---|
| 750090 | 1/1967 | Canada | 52/200 |
| 2628077 | 1/1978 | Fed. Rep. of Germany | 52/200 |

*Primary Examiner*—Reinaldo P. Machado
*Attorney, Agent, or Firm*—Allen D. Brufsky

[57] ABSTRACT

A low cost skylight which can be provided in kit form for installation includes at least two rafter bow members. Each of these members has a convex upper edge and a straight lower edge. The straight lower edge of each bow member rests on a rafter at the edge of a roof opening. The skylight includes a sheet of flexible, light-transmitting material which overlays the rafter bow members. Fasteners, such as round head wood screws, are used to fasten the upper and lower edges of the flexible sheet to the roof surface. Gaskets and flashing members are disclosed for establishing watertight seals at the edges of the skylight.

9 Claims, 3 Drawing Figures

BOWED SKYLIGHT

BACKGROUND OF THE INVENTION

The present invention relates to building components and more particularly to a low cost skylight which may be provided in kit form.

Skylights are sometimes used in residential or commercial buildings either to take advantage of the natural illumination provided by the sun or to provide decorating impact. Different kinds of skylights are known. Larger, flat-roofed commercial or residential buildings have employed "greenhouse" type skylights consisting of a metal or wooden frame for holding a number of individual panes of glass. Smaller commercial buildings or residences have generally been provided with "bubble" type skylights which comprise a molded plastic cover fitted onto a special base which is built into an opening through the roof structure. The opening can either be built in during construction or created by cutting an opening through the roof of an already-completed building.

While this "bubble" type of skylight generally performs satisfactorily if properly installed, it does have certain drawbacks. Since the "bubble" must be specially formed and since the base unit must be specially manufactured to accommodate different sizes of bubbles, the costs of the unit are higher than might be desired. Moreover, the skylight must be carefully installed to avoid leaks through the roof. If the installation is done by a professional, this adds to the cost. If the installation is carried out by the owner of the commercial or residential building, there is always the risk that leakage will become a problem.

SUMMARY OF THE INVENTION

The present invention overcomes these and similar problems associated with known prior art skylights. A skylight made in accordance with the invention is low in cost and can be provided in the form of a kit which may be readily installed even by persons with little or no experience or skill in the building crafts.

A skylight constructed in accordance with the present invention includes a plurality of rafter bow members. Each of these members has a convex upper edge and a straight lower edge. The straight lower edge rests on the surface of an exposed rafter at a roof opening. A sheet of flexible, light-transmitting material overlays the bow members and extends beyond the ends of those members. The opposite edges of the flexible sheet are secured to the roof. Sealing means are provided for establishing a watertight seal between the lower surface of the flexible sheet and the upper surface of each of the rafter bow members.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein;

DETAILED DESCRIPTION

Figure 1:
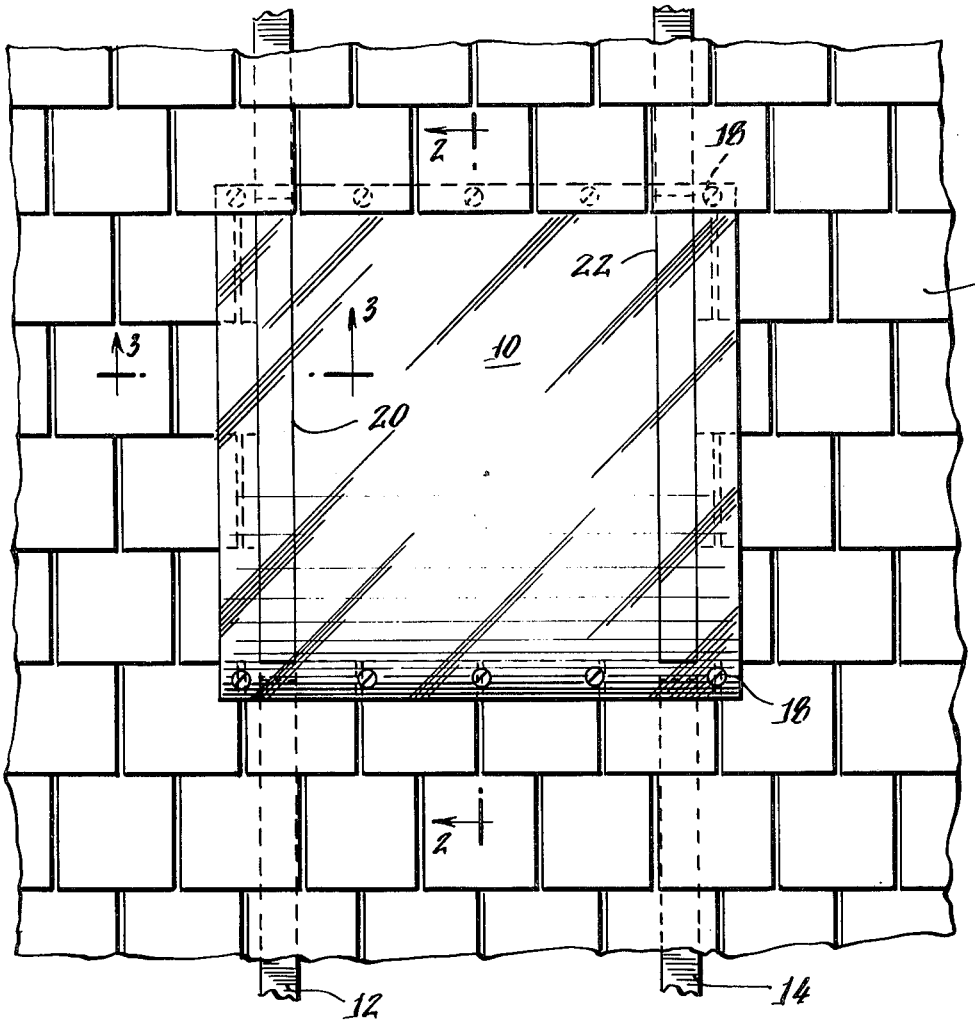
FIG. 1 is a plan view of an installed skylight constructed in accordance with the present invention.

Referring now to the drawings, and particularly to FIG. 1, a skylight constructed in accordance with the present invention includes a sheet 10 of a flexible, light-transmitting material which is preferably a high impact plastic material such as the different materials sold by manufacturers under the trademarks Plexiglass, Lucite or Lexan. The size of the sheet 10 is not critical as long as the sheet 10 is large enough to completely cover a roof opening shown as being formed between two rafters 12 and 14 which, along with other similar rafters, support a roof having a conventional covering such as a courses of shingles 16. The upper and lower edges of the flexible sheet 10 are tightly secured to the roof surface by plurality of fasteners, such as fastener 18. Fastener 18 is preferably a standard threaded fastener such as a round head wood screw made or at least plated with a corrosion-resistant material.

The flexible sheet 10 extends well beyond the rafters 12 and 14 on either side of the underlying opening. In practice, sheet 10 extends two to three inches beyond those rafters for reasons which will be discussed below. The upper edge of the sheet 10 is positioned beneath at least one row of shingles while the lower edge rests directly upon the surface of the shingles.

Figure 2:
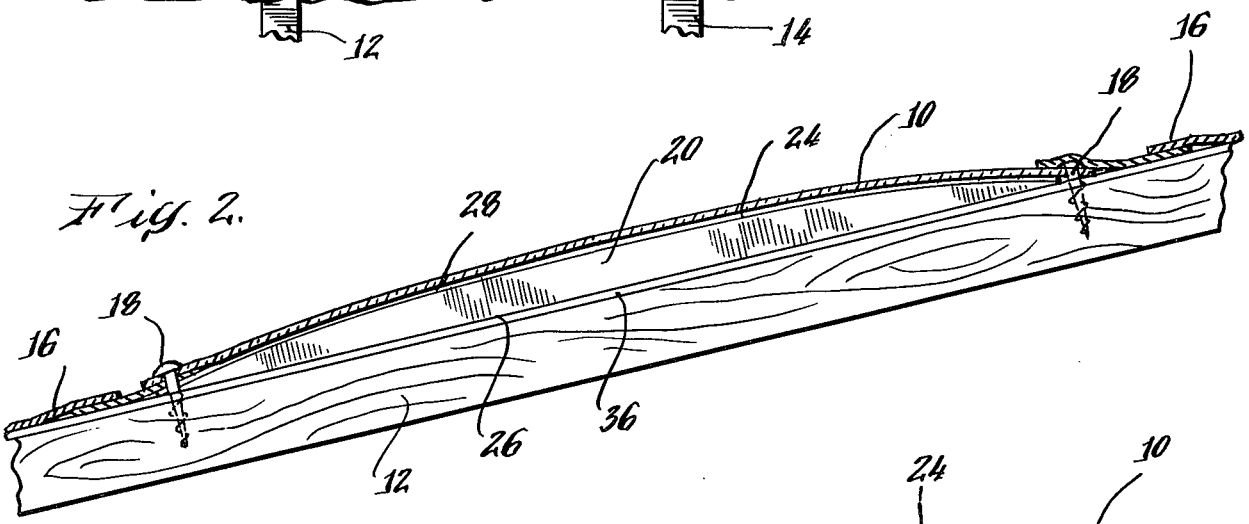
FIG. 2 is a cross sectional view taken along lines 2—2 of FIG. 1.

Referring now to FIGS. 1 and 2 together, the flexible sheet 10 is bowed outwardly by a pair of rafter bow members 20 and 22, which are shown in plan view in FIG. 1. Only rafter bow member 20 can be seen in FIG. 2. Each of the rafter bow members has a convex upper surface 24 and a straight or flat lower surface 26. The flat surface 26 rests upon one of the exposed rafters.

It should be understood that it is not absolutely essential that the upper surface of the rafter itself be exposed. It is common practice to use a sheathing layer of plywood 36 over the rafters. The rafter bow members can as easily be seated on the sheathing layer as on the rafter itself. The term "exposed rafter" should be construed as meaning either the rafter or overlying sheathing.

FIG. 2 shows how the upper or right edge of the flexible sheet member 10 is positioned beneath at least one course of shingles on the roof. The fasteners 18 spaced along the uppper edge are also concealed beneath the course of shingles. Moreover, as can be seen in FIG. 1, each fastener is preferably centered beneath one of the shingle tabs. Arranging the fasteners in this manner reduces the chances of water leakage around the fastener opening through the flexible sheet member 10. The lower edge of the flexible sheet 10 overlays the shingles on the roofing surface to allow rain draining from the sheet 10 to drain directly onto the shingles.

Figure 3:
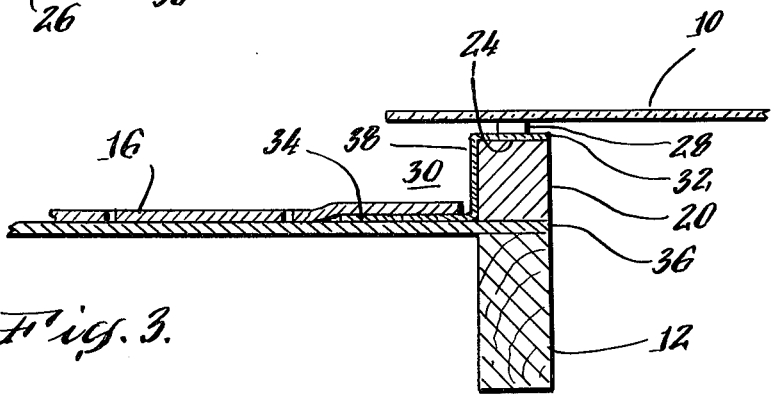
FIG. 3 is still another cross sectional view taken along lines 3—3 of FIG. 1.

Referring to FIGS. 2 and 3 together, a watertight seal is formed between the flexible sheet 10 and the rafter bow members by means of a sealing element 28, such as a rubber gasket, preferably used in combination with a flashing member 30 fabricated from a conventional material such as a galvanized tin. The flashing member 30 would be an integral, shaped member having a first convex area 32 which conforms to the upper surface of the rafter bow members, a second essentially planar area 34 which conforms to and rests against the sheathing 36 and a third or bridging area 38 connecting the areas 32 and 34.

It will be noted from FIG. 3 that the flexible sheet 10 extends beyond the rafter bow members at either side of the opening, preferably for two to three inches. This overhang, in combination with the rubber gasket 28 and flashing member 30 prevents leakage at the sides of the skylight.

A skylight constructed in accordance with the present invention is readily provided in kit form. Since the flexible sheet member 10 is considerably larger than the underlying opening which would be cut through the roof and since the rafter bow members are easily set in place, the skylight can be easily installed by persons with little experience or expertise in building crafts. Moreover, because of the simplicity of the design, the cost of the skylight is considerably lower than the cost of more conventional skylight units.

While there has been described what is considered to be a preferred embodiment of the invention, variations and modifications of the invention will occur to those skilled in the art once they become acquainted with the basic concepts of the invention. Therefore, it is intended that the appended claims shall be construed to include all such variations and modifications as fall within the true spirit and scope of the invention.

What is claimed is:

1. For installation in a roof opening having at least two exposed rafters, a low cost skylight comprising:

a plurality of rafter bow members, each having a convex edge and an opposite straight edge, said straight edge being in contact with one of the exposed rafters;

a sheet of flexible, light-transmitting material overlaying said rafter bow members and extending beyond the ends of said rafter bow members;

means for securing opposite edges of said sheet to the roof;

sealing means for establishing a watertight seal between the lower surface of said sheet of material and the upper surface of each of said rafter bow members.

2. A low cost skylight as recited in claim 1 further including first and second flashing members, each of said flashing members having a first area conforming to the curvature of the convex edge of one of said rafter bow members, a second area conforming to the surface of the roof adjacent said rafter bow member and an integral third area connecting the first and second areas.

3. A low cost skylight as recited in claim 2 wherein said sheet of flexible, light-transmitting material extends beyond the edges of the roof opening in all directions.

4. A low cost skylight as recited in claim 2 wherein said securing means comprises a plurality of fasteners extending into the roof surface at spaced points along the edges of said sheet.

5. A low cost skylight as recited in claim 3 wherein said securing means comprises a plurality of fasteners extending into the roof surface at spaced points along the edges of said sheet.

6. A low cost skylight as recited in claim 5 wherein the upper edge of said sheet and the second area of each said flashing member are covered by at least one layer of roofing material.

7. A kit for a low cost skylight comprising:

(a) at least two rafter bow members, each having a convex upper edge and a straight lower edge adapted to rest on an exposed rafter at a roof opening;

(b) a sheet of flexible, light transmitting material of sufficient size to cover the roof opening, and being sufficiently flexible to bend over the convex upper edges of the bow members;

8. A kit as recited in claim 7 further including at least two flashing members, each of said flashing members having a first area conforming to the curvature of the convex edge of one of said rafter bow members, a second substantially planar area and an integral third area connecting the first and second areas.

9. A kit as recited in claim 8 wherein said fasteners comprise threaded fasteners with head portions.

* * * * *